United States Patent [19]

Stephens

[11] Patent Number: 5,069,566

[45] Date of Patent: Dec. 3, 1991

[54] ACOUSTICALLY DAMPENED STRIKER BAR FOR IMPACT PRINTERS AND METHODS OF ASSEMBLY

[75] Inventor: Fred O. Stephens, Waynesboro, Va.

[73] Assignee: Genicom Corporation, Waynesboro, Va.

[21] Appl. No.: 548,832

[22] Filed: Jul. 6, 1990

[51] Int. Cl.[5] ..... B41J 11/02

[52] U.S. Cl. ..... 400/656; 400/661; 400/689

[58] Field of Search ..... 400/552, 648, 659, 660, 400/661, 661.1, 661.2, 661.3, 661.4, 689, 656, 657

[56] References Cited

U.S. PATENT DOCUMENTS

| | | | |
|---|---|---|---|
| 811,800 | 2/1906 | Small | 400/661.1 |
| 1,347,333 | 7/1920 | Houston | 400/661.2 |
| 1,592,392 | 7/1926 | Stickney | 400/661.3 |
| 1,629,129 | 5/1927 | Stickney | 400/661.4 |
| 1,693,533 | 11/1928 | Stickney | 400/661.4 |
| 1,836,906 | 12/1931 | Degener | 400/656 |
| 4,076,112 | 2/1978 | Effinger | 197/127 |
| 4,092,920 | 6/1978 | Barnak | 101/77 |
| 4,247,213 | 1/1981 | Wurscher | 29/132 |
| 4,453,848 | 6/1984 | Adkisson et al. | 400/661 |
| 4,583,272 | 4/1986 | Keller | 29/110 |

FOREIGN PATENT DOCUMENTS

| | | |
|---|---|---|
| 0062140 | 2/1982 | European Pat. Off. . |
| 3114169 | 10/1982 | Fed. Rep. of Germany . |
| 59-158273 | 9/1984 | Japan . |
| 61-280961 | 12/1986 | Japan . |
| 62-138264 | 6/1987 | Japan . |
| 2089731 | 6/1982 | United Kingdom . |

*Primary Examiner*—Edgar S. Burr
*Assistant Examiner*—Ren Yan
*Attorney, Agent, or Firm*—Nixon & Vanderhye

[57] ABSTRACT

A striker bar assembly includes a striker bar body having a recess at each of its opposite ends opening through top, bottom and end wall surfaces. The striker bar body has a flat impact surface perpendicular to the top and bottom surfaces. Generally T-shaped end members have legs for disposition in the striker body recesses. The wall surfaces of the striker body and legs of the members are spaced to provide a gap into which dampening material is provided. The gaps at each end of the striker bar assembly are of identical width in a front-to-back direction.

16 Claims, 3 Drawing Sheets

ACOUSTICALLY DAMPENED STRIKER BAR FOR IMPACT PRINTERS AND METHODS OF ASSEMBLY

BACKGROUND AND SUMMARY OF THE INVENTION

The present invention relates to an acoustically dampened striker bar for use in impact printers and particularly relates to a novel assembly and method of assembling a striker bar body and print frame mounting members one to the other to afford acoustical dampening.

Impact printers, particularly high-speed impact printers, use a variety of means to reduce the acoustic noise generated by the printhead impacting the striker bar or platen through the ribbon and paper. For example, a striker bar formed of an elastomeric material to absorb vibration and soften impact has been used. However, print speed is limited because of the long dwell times of the print head against the ribbon and paper caused by the viscous dampening effect of the elastomer. Often, the rigid striker bar is shock-mounted to the printer frame through an elastomeric dampening material at the mounting points. This type of mounting, however, increases the likelihood of alignment problems and virtually guarantees that striker bars must be adjusted to maintain parallelism between the striker bar and print carriage rails of the printer. Moreover, most elastomers take a compression set and, consequently, field alignment problems, as well as acoustical problems, arise. The striker bar may also be hard-mounted to the printer frame, with the frame being isolated from the enclosure and the table top on which the printer sits. However, the dampening in this arrangement is less effective the greater the distance the dampening material is from the source of the noise and, consequently, more dampening material will be needed to obtain the same acoustic levels.

According to the present invention, there is provided an acoustically dampened striker bar that enables direct placement of the solid striker bar in the printer with no adjustment, enables reduction in acoustic noise levels to very low levels, has substantially insignificant motion while dampening thereby having little or no effect on print quality and is so constructed that the molded elastomeric material thereof has stresses which inherently cancel one another, virtually eliminating shrinkage of the material in the front-to-back, i.e., acoustical dampening, direction. Importantly, the striker bar of the present invention includes a rigid striker or impact surface and yet is directly dampened to the printer frame. The installation may be obtained without adjustment to compensate for dampening layers in the striker bar, i.e., no adjustment for parallelism of the striker bar relative to the carriage rails is required.

To accomplish the foregoing, the striker bar assembly of the present invention includes a rigid striker bar body, preferably formed of rigid steel or cast iron, a pair of end pieces or members for the striker bar body, preferably formed by a powdered metal process, and an elastomeric dampening material for interposition in a unique and novel manner between the end pieces and the striker bar body. In a preferred embodiment of the present invention, the end mounting members are generally T-shaped, with the cross part of the T shape having tapped mounting holes for mounting to the printer frame. The opposite ends of the striker bar body are recessed to form a generally U-shaped opening which may be machined or cast. The striker bar body has a front striker or impact surface and the recessed or slotted ends of the striker bar body open through the top and bottom surfaces thereof to form generally U-shaped ends. The striker bar body also has a greater depth than height. The distance between the wall surfaces defining each recess in the striker bar body is substantially larger than the width of the leg or projecting element of each end member. Thus, when the end members are assembled onto the striker bar by inserting the elements into the recesses, the elements and striker bar body are spaced one from the other to provide a uniform gap therebetween. That is, when the element of the end member is inserted into the recess, the wall surfaces defining the recess in the plane of the striker bar body behind the impact surface are spaced equally from the wall surfaces of the element.

These gaps are filled with dampening material. The dampening material is preferably an elastomer, for example, santoprene, nitrile, PVC, urethane or double-sided adhesive foam tapes and the like. It will be appreciated that the dampening material can be formed in the striker bar assembly by molding, casting or in place, dependent on the type of material used. If extruded materials are used, they are cut to size and adhesively secured in place with pressure. For molding, for example, injection-molding of santoprene, PVC or urethanes or transfer-molding with nitrile or SBR, the geometry of the parts becomes important to prevent flooding of the dampening material during molding. Thus, the end pieces are provided with projecting crush ribs which extend beyond the surfaces of the striker bar. During molding, these ribs are crushed to prevent flooding of the dampening material.

In a preferred embodiment according to the present invention, there is provided an acoustically dampened striker bar assembly for an impact printer comprising an elongated striker bar having wall surfaces defining a recess in each of its opposite ends, a member at each of the opposite ends of the striker bar for mounting the bar in the printer, each member having an element received in the recess in the corresponding end of the striker bar, the element having wallsurfaces spaced from and out of contact with the wall surfaces of the striker bar recess and an elastomeric dampening material disposed between the wall surfaces of the elements and the recesses, respectively.

In a further preferred embodiment according to the present invention, there is provided an acoustically dampened striker bar assembly for an impact printer comprising an elongated striker bar having top and bottom surfaces and a front flat impact surface therebetween, the bar- having wall surfaces defining a recess in at least one end thereof and opening the rough the end and through the top and bottom surfaces. A generally T-shaped member is provided at one end of the striker bar for mounting the bar in the printer, the leg of the T-shaped member being received in the recess in one end of the bar and having-wall surfaces spaced from an out of contact with the wall surfaces of the striker recess, the member also having an end face in spaced opposition to an end face on the striker bar end. Elastomeric dampening material is disposed between the wall surfaces of the leg and the recess and between the end faces of the member and striker bar, respectively.

In a further preferred embodiment according to the present invention, there is provided a method of fabricating a striker bar assembly for an impact printer comprising forming endwise opening recesses at each of the opposite ends of a striker bar body, providing a pair of mounting members each including an element projecting therefrom for reception in the recess, dimensioning each element and recess to provide a gap between the element and the wall surfaces defining the recess when the element is disposed in the recess, disposing the elements in the corresponding recesses at opposite ends of the striker bar body and disposing an elastomeric material in the gap such that the elements and the striker bar body are secured one to the other and out of direct contact with one another.

Accordingly, it is a primary object of the present invention to provide a novel and improved striker bar assembly and methods of manufacturing the assembly which enable direct replacement of the striker bar assembly without further adjustment, afford little or no impact on print quality as a result of dampening motion and enable a molding configuration that equalizes molded-in-stresses to virtually eliminate shrinkage of the dampening material in a front-to-back direction.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
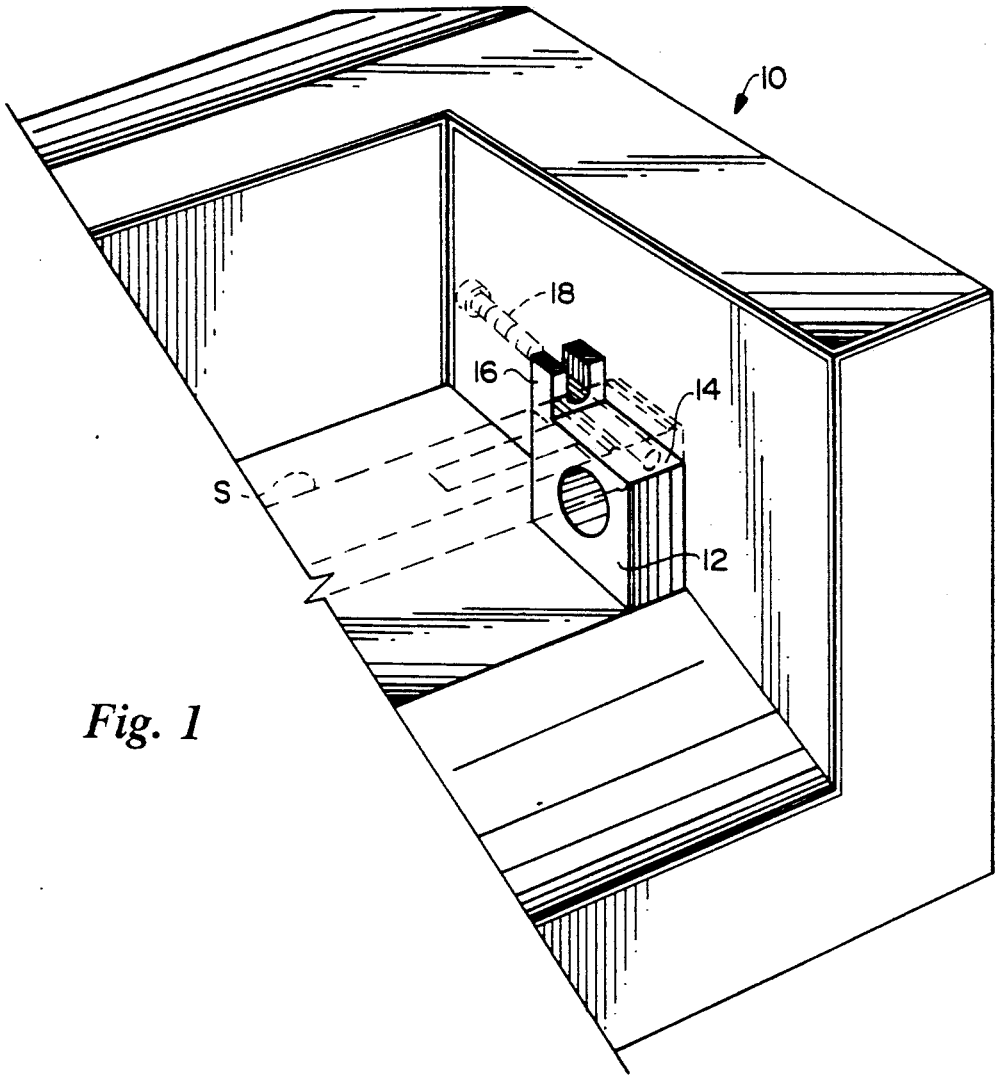
FIG. 1 is a fragmentary perspective view of the end of a printer illustrating the manner of mounting a striker bar constructed in accordance with the present invention.

Referring now to the drawings, particularly to FIG. 1, there is illustrated a printer housing, generally designated 10, the various operational elements of the printer being omitted from the drawing figure for sake of clarity. Suffice to say that the printer housing 10 includes a mounting block 12 having a mounting surface 14 on which a striker bar may be mounted. One end of mounting block 12 carries an upwardly projecting flange 16 which is bifurcated to receive a mounting screw 18 therebetween for clamping the striker bar against the flange 16 of mounting block 12 The striker bar is illustrated by the dashed lines, designated S, in FIG. 1.

Figure 2:
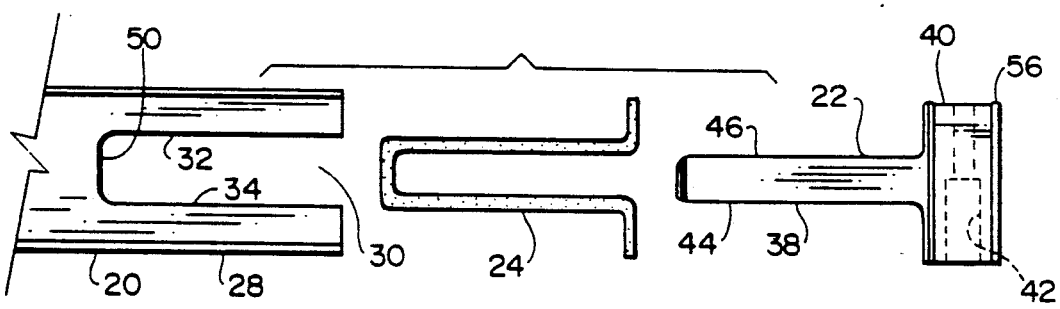
FIG. 2 is a fragmentary enlarged and exploded top plan view of an end of the striker bar illustrating the three principal elements thereof.
Figure 3:
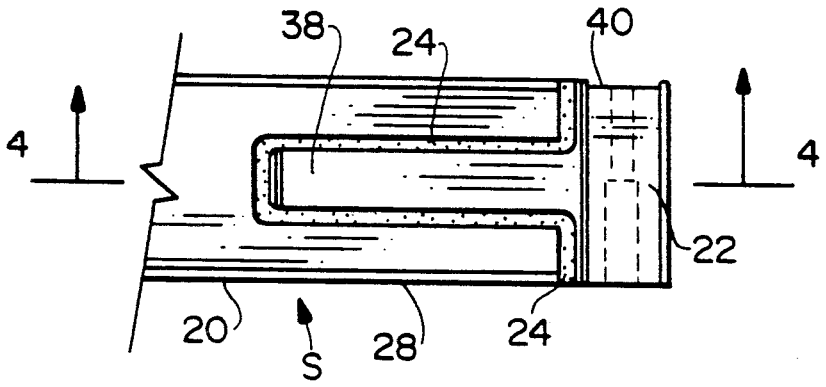
FIG. 3 is a fragmentary top plan view of the striker bar illustrated in FIG. 2.
Figure 4:
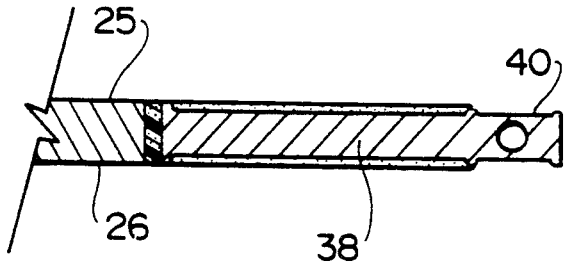
FIG. 4 is a cross-sectional view thereof taken generally about on line 4—4 in FIG. 3.

Referring now to FIGS. 2–4, striker bar S is comprised of an assembly of parts, including an elongated striker bar body 20, end members 22 at each of the opposite end of striker bar 20 and an elastomeric dampening material 24 disposed between the end members 22 and the striker bar body 20. The striker bar body 20 comprises a bar, generally rectilinear in cross-section, and formed of a metal material, preferably cast iron or rigid steel. The body 20 has generally flat, top and bottom surfaces 25 and 26, respectively, and a front impact surface 28. The impact surface 28 is a flat surface perpendicular to the top and bottom surfaces 25 and 26, respectively. It will be appreciated that the depth dimension from front to back of the striker bar body 20 is greater than its height dimension between top and bottom surfaces 25 and 26, respectively. At each of the opposite ends of the striker bar body 20, there is provided a recess 30 defined by spaced opposing, generally flat, parallel extending wall surfaces 32 and 34. The wall surfaces 32 and 34 lie parallel to the front impact surface 28. Recess 30 opens through the top and bottom wall surfaces 25 and 26 of body 20. The recesses 30 may be machined into the striker bar body 20 or formed during casting.

End member 22 is provided each of the opposite ends of the striker bar S and, in assembly, a permanent part thereof. In a preferred form, each end member 22 is generally T-shaped, having a leg 38 and an end flange 40. In cross-section, each of the legs 38 and flanges 40 is generally rectilinear, having flat top and bottom surfaces generally parallel to top and bottom surfaces 25 and 26 of the striker body 20. For purposes of securing the end members 22 and hence the striker bar assembly S to the printer, the flanges 40 have tapped mounting holes for receiving the screws 18 whereby the striker bar assembly can be secured to the printer 10.

The leg 38 of each end member has flat parallel extending front and rear walls 44 and 46, respectively, and top and bottom walls which, in assembly, lie flush with the top and bottom surfaces of the striker bar body 20. The wall surfaces 32 and 34 of striker bar body 20 and wall surfaces 44 and 46 of end members 40 are dimensioned such that when leg 38 is received in opening 30, the wall surfaces of the respective parts are spaced one from the other, defining a gap therebetween. Likewise, the end face of the leg 38 in assembly is spaced from the end face 50 at the bottom of the recess 30. As illustrated, a dampening material 52 is disposed in the gap between the end members 40 and the corresponding recesses 30 of the striker bar body 20. As indicated, the dampening material 52 can be one of any number of elastomers that have vibration dampening properties, including, for example, santoprene, nitrile, SBR, PVC elastomers such as C-1002 or C-1100 elastomer materials, manufactured by E.A.R. Specialty Composites Corp. of Newark, DE, urethanes, such as E.A.R.'s Isoloss materials, double-sided adhesive foam tapes manufactured by 3M Company and the like. The dampening material 24 can be formed by one of several methods. For example, nitrile, SBR, santoprene or urethane parts can be molded and then glued in place. Direct insert molding may likewise be used.

In the case of injection molding with santoprene, PVC or injection-moldable urethanes, and transfer molding, as with nitrile or SBR, it is important to prevent the flooding of the mold upon closing thereof. To accomplish this, the end flanges 40 are provided with ribs 56 which project from the top, bottom and rear surfaces thereof but not from the front surface. For example, where end members 22 are formed of a powdered metal, the powdered metal can be molded to form the projecting ribs. Thus, the ribs, when formed, stand slightly higher in the width and depth directions compared to the striker bar body. As the mold closes, it crushes the ribs to the height and depth of the striker bar body, thus preventing the molding material from flooding completely around the end members. Additionally, these ribs maintain the end members in alignment with the striker bar during molding. This is significant because the front face of each end member flange 40 must lie flush with the front impact surface 28 of the striker bar assembly. By properly positioning the end members relative to the striker bar body during assembly, the assembly need not be finish ground to render the impact surfaces flush one with the other.

In assembly, it is significant that the gaps between the leg of each end member 22 and the front and rear wall surfaces defining the recesses 30 have the same width in a front-to-back direction, particularly when using injection molded material. It is important to avoid non-uniform shrinkage of the material in each of those gaps which might otherwise have a tendency to pull the end members out of alignment with the striker bar impact surface. By forming two equal thicknesses of molded dampening material in a front-to-back direction and disposing the material in the gaps, the shrinkage in the gaps during molding is eliminated, placing the two webs of dampening material under equal tension.

Figure 5:
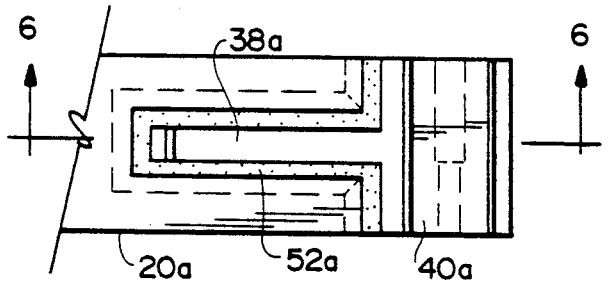
FIG. 5 is a view similar to FIG. 3 illustrating another embodiment of the striker bar hereof.
Figure 6:
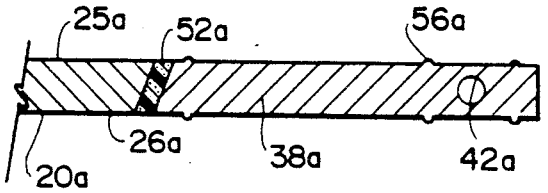
FIG. 6 is a cross-sectional view thereof taken generally about on line 6—6 in FIG. 5.
Figure 7:
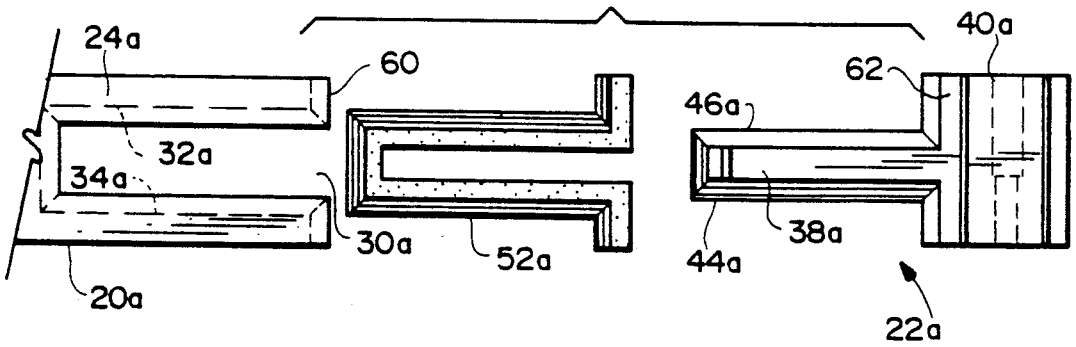
FIG. 7 is a view similar to FIG. 2 illustrating the end parts of the striker bar assembly of FIGS. 5 and 6.

Referring now to the embodiment hereof illustrated in FIGS. 5–7, wherein like reference numerals apply to like parts followed by the suffix "*a*", there is illustrated another form of the invention. In this embodiment, the wall surfaces 44*a* and 46*a* of the legs of the end members are tapered to converge toward the top surface of the striker bar assembly. Additionally, the corresponding wall surfaces 32*a* and 34*a* of the striker bar body 20*a* lie parallel to the wall surfaces 44*a* and 46*a* and, consequently, converge toward the top surface 25*a* of the striker bar body 20*a*. As. in the previous embodiment, the gap between the wall surfaces of the leg of each end member 22 and the respective wall surfaces defining the recess 30*a* is uniform front to back. As illustrated in FIG. 7, the end face of leg 38*a* is similarly tapered, with a corresponding taper in the end face of the recess 30*a*. Likewise, the end faces 60 of the striker bar body 20*a* and the end faces 62 of the flanges 40*a* facing the striker bar assembly are correspondingly tapered. In this manner, the wedge configuration of the end members 36*a* affords high reliability and enables compressive support of the main striker bar body through the dampening material 52*a* and the bond between the dampening material and the striker bar body and end members. That is, whereas, in the previous embodiment, the end members supported the striker bar body in shear, this second embodiment provides support for the striker bar body in compression through the dampening material.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An acoustically dampened striker bar assembly for an impact printer comprising:

an elongated striker bar having wall surfaces defining a recess in each of its opposite ends;

a member at each f the opposite ends of said striker bar for mounting the bar in the printer;

each member having an element received in the recess in the corresponding end of said striker bar, said element having wall surfaces spaced from and out of contact with said wall surfaces of said striker bar recess;

an elastomeric dampening material disposed between said wall surfaces of said elements and said recesses, respectively; and said striker bar having a printer impact surface along a front surface thereof and a height dimension smaller than its depth dimension, each said recess being elongated and opening through the top, bottom and end surfaces of said striker bar, said elastomeric material similarly opening through each of the top and bottom surfaces of said striker bar.

2. An assembly according to claim 1 wherein said wall surfaces of said elements and said wall surfaces of said striker bar recesses define respective gaps therebetween on front and back sides of said elements, said gaps being substantially equal in width in a direction perpendicular to the printer impact surface of said striker bar whereby a substantially equal thickness of said material is provided in each gap and in a direction perpendicular to the printer impact surface of said striker bar.

3. An assembly according to claim 1 wherein each of said end members is out of direct contact with said striker bar.

4. An assembly according to claim 1 including means carried by each member for mounting said striker bar in a printer.

5. An assembly according to claim 1 wherein said striker bar has an end face at each of its opposite ends, each of said members having an end face in spaced opposition to said end face on the corresponding end of said striker bar and defining an end gap therebetween. and elastomeric dampening material disposed in said end gaps.

6. An assembly according to claim 1 wherein said striker bar has an interior end face defining the recess at each of its opposite ends, each of said elements having an end face in spaced opposition to said interior end face defining the corresponding recess, and elastomeric dampening material disposed between said end faces of said recess and element.

7. An assembly according to claim 1 wherein the striker bar has a printer impact surface, each end member having a front face lying flush with the printer impact surface of said striker bar.

8. An assembly according to claim 1 wherein each said recess and said element are rectilinear, having substantially flat sides.

9. An acoustically dampened striker bar assembly for an impact printer comprising:

an elongated striker bar having top and bottom surfaces and a front flat impact surface therebetween, said bar having wall surfaces defining a recess in at least one end thereof and opening through said end and through said top and bottom surfaces, said striker bar having ann end face in said recess in at least said one end thereof;

a generally T-shaped member at said one end of said striker bar for mounting the bar in the printer, said T-shaped member having a leg;

the leg of said T-shaped member being received in the recess in said one end of said striker bar, said leg having wall surfaces spaced from and out of contact with said wall surfaces of said striker bar recess, said member having an end face in spaced opposition to said end face on the striker bar; and an elastomeric dampening material disposed between said wall surfaces of said leg and said recess and between said end faces of said member and striker bar, respectively.

10. An assembly according to claim 9 wherein said wall surfaces of said leg and said striker bar recess defining respective gaps therebetween on front and back sides of said legs in a plane common with said impact surface, said gaps being substantially equal in width in said plane in a direction perpendicular to said striker bar impact surface whereby a substantially equal thickness of said material is provided in each gap in said plane and in a direction perpendicular too said striker bar impact surface.

11. An assembly according to claim 9 wherein said end member has a front face lying flush with the striker bar impact surface.

12. An assembly according to claim 9 wherein said striker bar has a height dimension smaller than its depth dimension, said elastic material similarly opening through each of the top and bottom surfaces of said striker bar.

13. An assembly according to claim 12 wherein each said recess and said leg are rectilinear. having substantially flat generally parallel sides.

14. An assembly according to claim 12 wherein said wall surfaces of said recess are tapered toward one another in a direction toward one of said top and bottom surfaces of said striker bar, said wall surfaces of said leg being correspondingly tapered.

15. A method of fabricating a striker bar assembly for an impact printer, comprising:

forming endwise opening recesses at each of the opposite ends of a striker bar body;

providing a pair of mounting members each including an element projecting therefrom for reception in said recess;

dimensioning each said element and recess to provide a gap between said element and the wall surfaces defining said recess when said element is disposed in said recess;

disposing said elements in the corresponding recesses at opposite ends of said striker bar body;

disposing an elastomeric material in said gap such that said elements and said striker bar body are secured one to the other and out of direct contact with one another;

molding the elastomeric material in said gap; and forming crush ribs about said end members of a lateral extent greater than the corresponding lateral extent of said striker bar body and crushing said ribs while molding to prevent the molded material from flooding about said end members.

16. A method according to claim 18 wherein each said mounting member has an end face in opposition to and spaced from an end face of said striker bar body when said member is finally seated in said recess. and disposing elastomeric material into said spaced to acoustically isolate each said member from said striker bar body.

* * * * *